US011402169B1

(12) United States Patent
Sohegian

(10) Patent No.: US 11,402,169 B1
(45) Date of Patent: Aug. 2, 2022

(54) SWITCH BARREL RIFLE WITH ADJUSTABLE HEADSPACE

(71) Applicant: Kevin Michael Sohegian, Valley Center, CA (US)

(72) Inventor: Kevin Michael Sohegian, Valley Center, CA (US)

( * ) Notice: Subject to any disclaimer, the term of this patent is extended or adjusted under 35 U.S.C. 154(b) by 0 days.

(21) Appl. No.: 17/217,888

(22) Filed: Mar. 30, 2021

Related U.S. Application Data

(60) Provisional application No. 63/003,205, filed on Mar. 31, 2020.

(51) Int. Cl.
*F41A 21/48* (2006.01)

(52) U.S. Cl.
CPC ..... *F41A 21/482* (2013.01); *F41A 21/485* (2013.01)

(58) Field of Classification Search
CPC .... F41A 3/16; F41A 3/18; F41A 21/48; F41A 21/481; F41A 21/482; F41A 21/484; F41A 21/485; F41A 21/487; F41A 21/488
See application file for complete search history.

(56) References Cited

U.S. PATENT DOCUMENTS 534,691 A * 2/1895 Hepburn ..... F41A 21/482 42/75.02
1,373,888 A * 4/1921 Johnson ..... F41A 21/482 42/75.02
1,628,798 A * 5/1927 Nelson ..... F41A 21/482 42/75.02
2,841,909 A 7/1958 Temple
3,731,418 A * 5/1973 Birkenhagen ..... F41A 21/481 42/75.02
3,972,143 A 8/1976 Wild
4,215,599 A 8/1980 Batchelder
4,297,801 A 11/1981 Kahn
4,547,988 A * 10/1985 Nilsson ..... F41A 3/18 42/16
4,791,748 A * 12/1988 Leskinen ..... F41A 3/66 42/75.02
5,706,599 A 1/1998 Knight
5,987,797 A 11/1999 Dustin
(Continued)

FOREIGN PATENT DOCUMENTS

CA 2745927 A1 * 1/2013 ..... F41A 21/482

*Primary Examiner* — Gabriel J. Klein
(74) *Attorney, Agent, or Firm* — Quickpatents, LLC; Kevin Prince

(57) ABSTRACT

An interchangeable barrel system for a firearm includes one or more barrels each having an outer surface, and an inner surface defining a longitudinal bore open between a muzzle end and an action end. The action end has a threaded portion that includes one or more tangential notches formed partially therethrough. A receiver includes one or two threaded adjustment bolt apertures that tangentially intersect a barrel port. In use, with the action end of one of the barrels threadedly engaged with the barrel port and manually tightened to align one of the threaded adjustment bolt apertures with one of the notches, an adjustment bolt is tightened to contact an end of the notch to apply a tangential force to the barrel to further tighten the barrel within the receiver and to provide a desired headspace between the action end of the barrel and a bolt of the firearm.

10 Claims, 7 Drawing Sheets

(56) References Cited

U.S. PATENT DOCUMENTS

| | | | | |
|---|---|---|---|---|
| 6,450,079 | B1 * | 9/2002 | Bourdin | F41A 21/36 89/14.3 |
| 6,609,323 | B1 | 8/2003 | Donnelly | |
| 8,230,633 | B1 | 7/2012 | Sisk | |
| 8,490,312 | B2 | 7/2013 | Barrett | |
| 8,505,227 | B2 | 8/2013 | Barrett | |
| 8,707,605 | B2 | 4/2014 | Jamison | |
| 8,931,198 | B2 | 1/2015 | Aalto | |
| 9,163,889 | B2 | 10/2015 | Constant | |
| 9,702,652 | B1 | 7/2017 | Jackson | |
| 9,857,138 | B2 | 1/2018 | Geissele | |
| 10,030,930 | B2 | 7/2018 | Hill | |
| 10,466,006 | B2 | 11/2019 | Hill | |
| 2005/0188591 | A1 | 9/2005 | Stone | |
| 2009/0031607 | A1 | 2/2009 | Robinson | |
| 2012/0137557 | A1 * | 6/2012 | Klotz | F41A 3/22 42/16 |
| 2012/0174379 | A1 | 7/2012 | Teper | |
| 2013/0180145 | A1 * | 7/2013 | Behling | F41G 11/003 42/16 |
| 2013/0219765 | A1 | 8/2013 | Ibarguren | |
| 2014/0352191 | A1 | 12/2014 | Fritz | |
| 2017/0115081 | A1 | 4/2017 | Maranli | |
| 2019/0086175 | A1 * | 3/2019 | Karagias | F41A 21/48 |

* cited by examiner

SWITCH BARREL RIFLE WITH ADJUSTABLE HEADSPACE

CROSS-REFERENCE TO RELATED APPLICATIONS

This application claims the benefit of U.S. Provisional Patent Application 63/003,205, filed on Mar. 31, 2020, and is incorporated herein by reference.

STATEMENT REGARDING FEDERALLY SPONSORED RESEARCH AND DEVELOPMENT

Not Applicable.

FIELD OF THE INVENTION

This invention relates to switch-barrel rifles, and more particularly to an improved attachment and tightening mechanism therefore.

BACKGROUND

Barrels of firearms, and particularly those of rifles, experience a tremendous amount of internal pressure upon firing a bullet therethrough, and as such barrels are typically only reliable and safe for a limited number of rounds. However, other portions of the firearm, such as the receiver, bolt, trigger, and stock do not have such a limitation. As such it would be desirable to exchange an end-of-life barrel with a new barrel and not have to discard the entire firearm.

Further, certain barrel lengths or calibers may be desired for one type of shooting scenario, while a different barrel having a different length or caliber may be desired for another shooting scenario. Accordingly, it would be advantageous to be able to interchange one barrel for another in such a situation. Further, for certain types of ammunition, more accuracy can be obtained by finely adjusting the headspace between the receiver end of the barrel and the bolt of the firearm.

So-called "switch-barrel" firearms allow for the interchanging of barrels on a firearm receiver, but heretofore the mechanisms that allow such exchanges are complicated, cumbersome to use, and do not provide a level of adjustment to the tightness of the barrel within the receiver or to the headspace created in the chamber of such a firearm.

Therefore, there is a need for a system that allows for the interchanging of a firearm barrel on the receiver of the firearm. Such a needed invention would allow for fine adjustment of both the tension of the barrel within the receiver of the firearm as well as the headspace between the barrel and the bolt of the firearm. The present invention accomplishes these objectives.

SUMMARY OF THE INVENTION

The present device is an interchangeable barrel system for a firearm, such as a rifle. One or more barrels each have an outer surface and an inner surface that defines a longitudinal bore open between a muzzle end of the barrel and an action end of the barrel.

The action end of the barrel has a threaded portion on the outside surface thereof that includes one or two tangential notches formed partially through the threaded portion. An end of each notch defines a stop. The notch extends through the outer surface but not through to the bore.

A receiver of the firearm includes a barrel port that has an internal threaded surface adapted to receive the threaded portion of the action end of any of the barrels. The receiver includes one or two threaded adjustment bolt apertures that tangentially intersect the barrel port and that can be coaxially aligned with one of the notches depending by rotating the barrel within the barrel port.

For each of the threaded adjustment bolt apertures, the system includes a threaded adjustment bolt that has a distal end adapted for threaded engagement with one of the adjustment bolt apertures, and a proximal end that includes a driver receiver. The threaded adjustment bolt can be coaligned with the notch until the distal end of the threaded adjustment bolt contacts the end of the notch.

In use, with the action end of one of the barrels threadedly engaged with the barrel port and manually tightened to align each threaded adjustment bolt aperture with one of the notches, when the adjustment bolt is tightened it contacts the stop to apply a tangential force to the barrel to further tighten the barrel within the receiver and to provide a desired headspace between the action end of the barrel and a bolt of the firearm. In this manner the fit of the barrel into the receiver can be adjusted, as well as the headspace, as desired. If the barrel becomes damaged, or for any other reason, the barrel can be interchanged with another of the barrels in a similar manner.

In embodiments having two of the threaded adjustment bolts on opposing sides of the stop, one of the threaded adjustment bolt is used to tighten the barrel into the barrel port, and the other threaded adjustment bolt is used to loosen the barrel from the barrel port.

The present invention is a system that allows for the interchanging of firearm barrels on the receiver of a firearm. The present system allows for fine adjustment of both the tension of the barrel within the receiver of the firearm as well as the headspace between the barrel and the bolt of the firearm. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
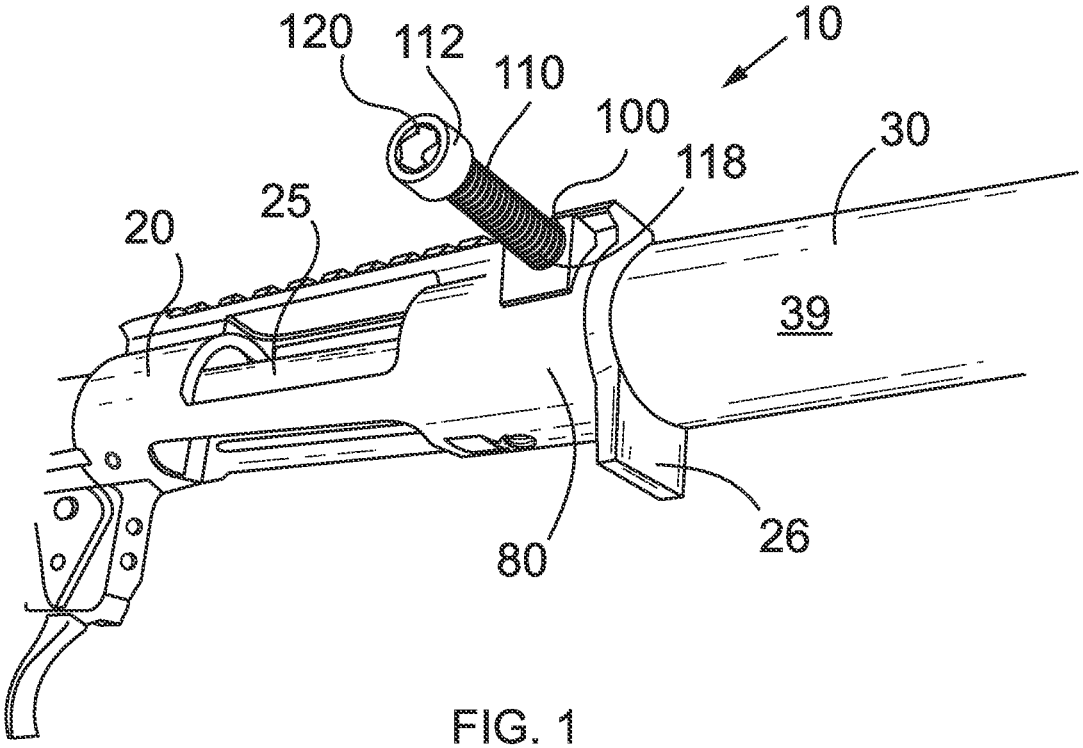
FIG. 1 is a perspective view of the invention.
Figure 2:
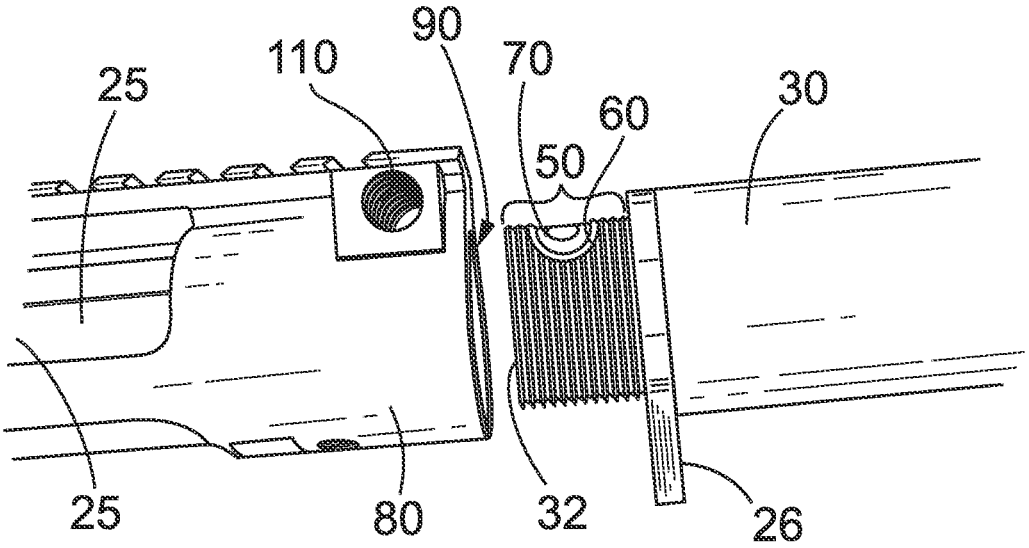
FIG. 2 is an exploded side elevational view of the invention, illustrating a barrel separated from a receiver.

FIGS. 1 and 2 illustrate an interchangeable barrel system 10 for a firearm 20, such as a rifle. The firearm 20 is of the type having at least a stock 28 and a receiver 80 that has a threaded barrel port 90. One or more barrels 30 each have an outer surface 39 and an inner surface 31 that defines a longitudinal bore 40 open between a muzzle end 38 of the barrel 30 and an action end 32 of the barrel 30. Such a barrel 30 is made with a strong steel material, such as chrome molybdenum steel, carbon steel, stainless steel, or the like.

Figure 3:
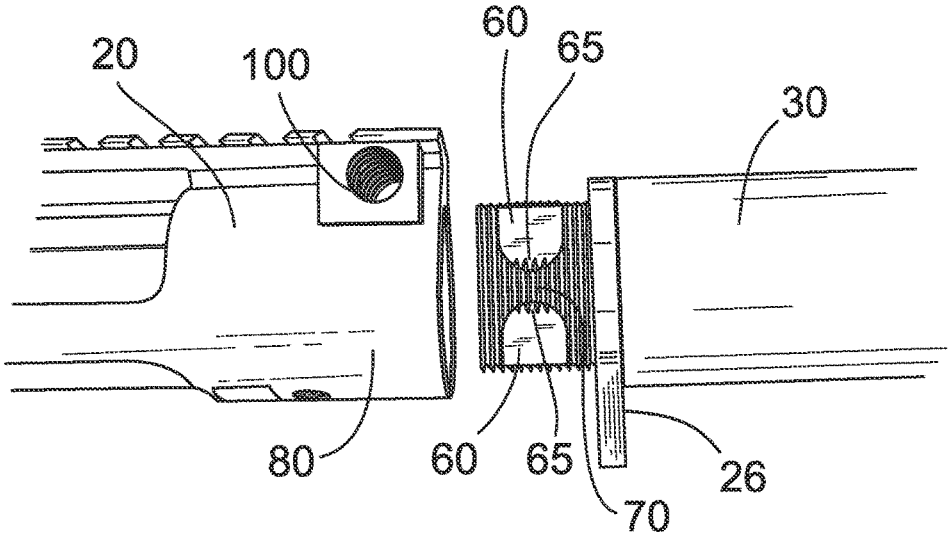
FIG. 3 is a side elevational view of the invention, illustrating the barrel partially inserted into the receiver.
Figure 4:
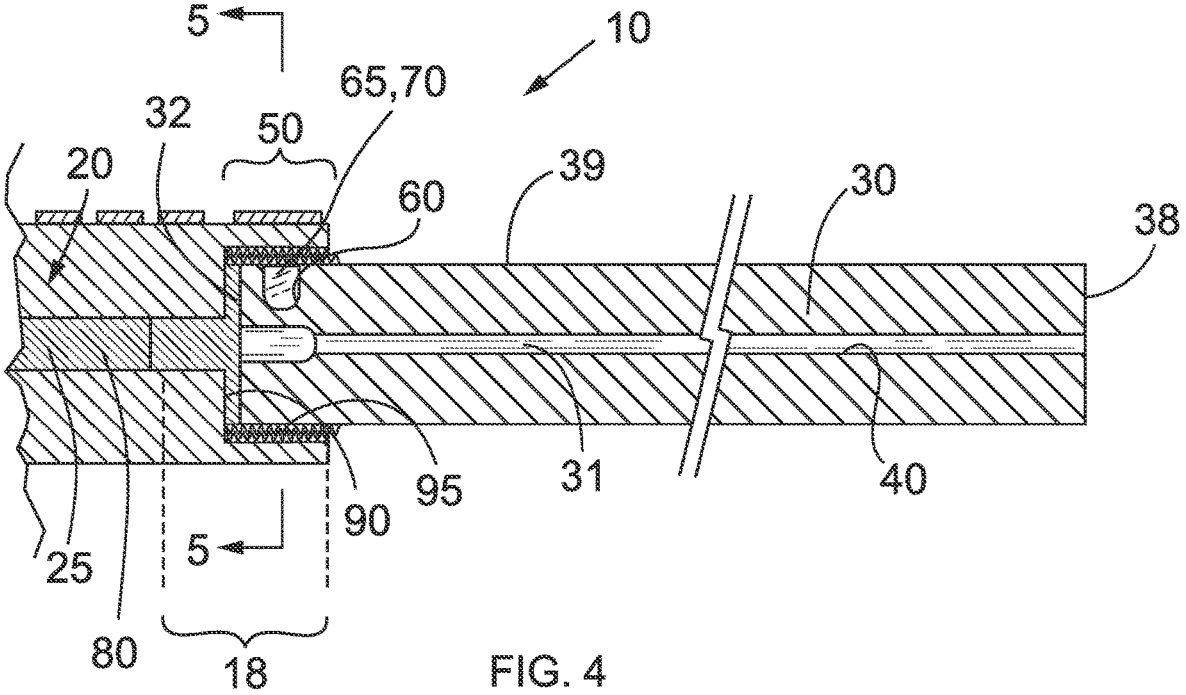
FIG. 4 is a side elevational cross-sectional view of the invention, taken along a longitudinal axis of the barrel.
Figure 5:
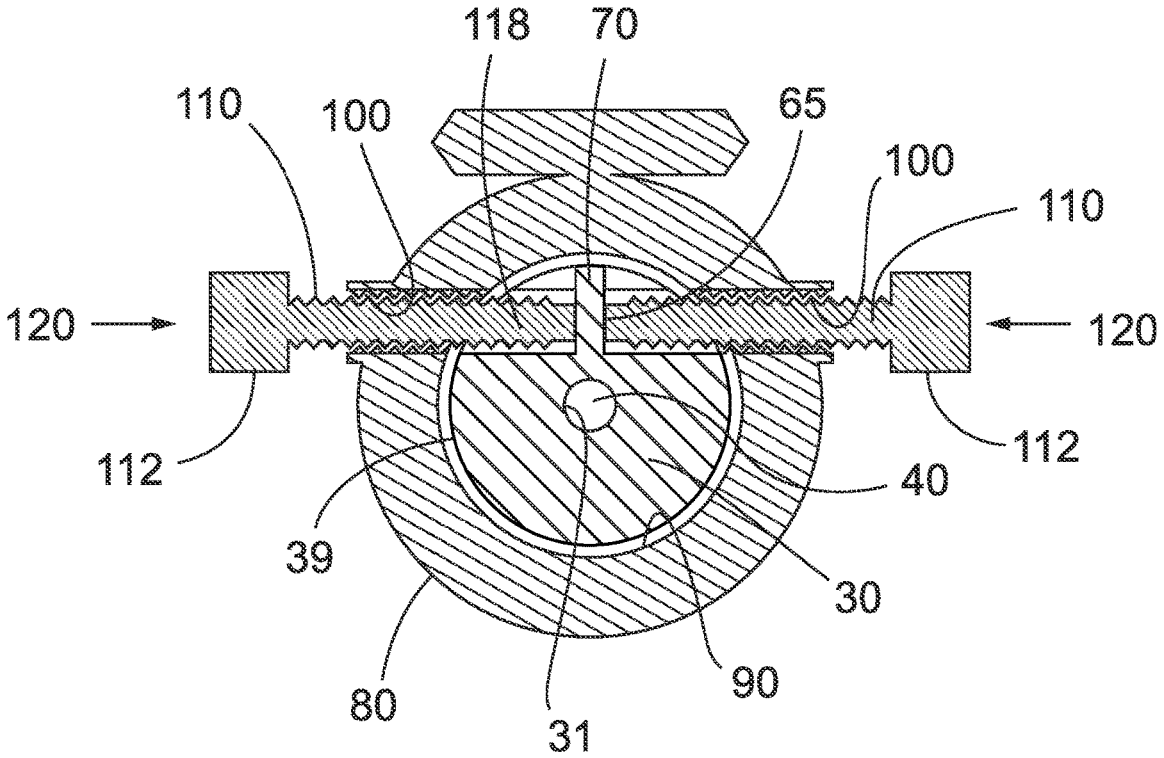
FIG. 5 is a cross-sectional view of the invention, taken along lines 5-5 of FIG. 4 and further including two threaded adjustment bolts of the invention.

The action end 32 of the barrel 30 has a threaded portion 50 on the outside surface 39 thereof that includes one or, preferably, two tangential notches 60 formed partially through the threaded portion 50 (FIGS. 3-5). An end 65 of each notch 60 defines a stop 70. The notch 60 extends through the outer surface 39 but not through to the bore 40.

A receiver 80 of the firearm 20 includes a barrel port 90 that has an internal threaded surface 95 (FIG. 4) adapted to receive the threaded portion 50 of the action end 32 of any of the barrels 30. In one embodiment, illustrated in FIGS. 1-5, the receiver 80 includes one or two threaded adjustment bolt apertures 100 that tangentially intersect the barrel port 90 and that can be coaxially aligned with one of the notches 60 depending by rotating the barrel 30 within the barrel port 90.

Figure 6:
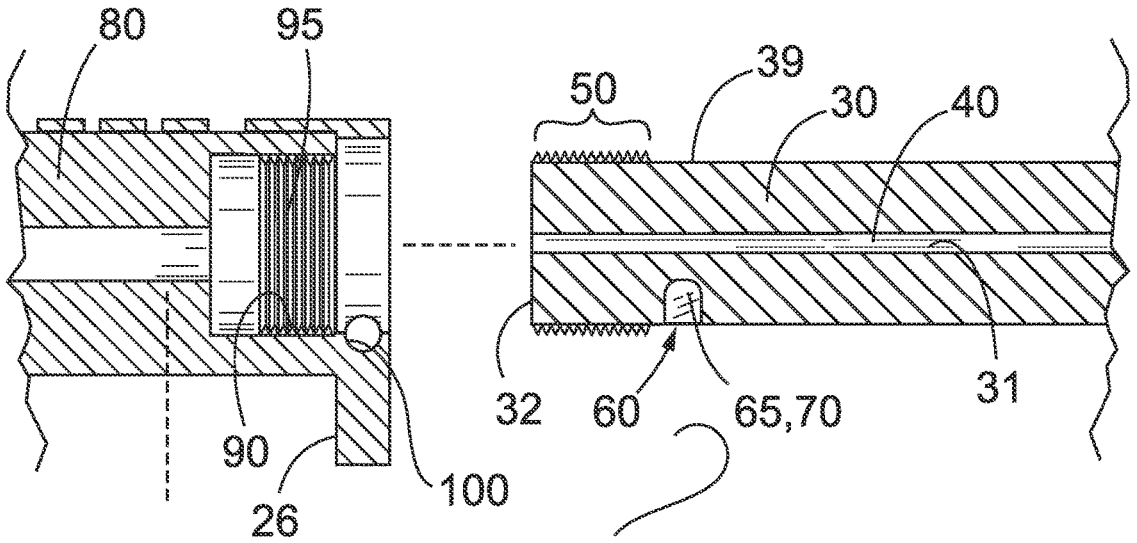
FIG. 6 is an exploded cross sectional view of an alternate embodiment of the invention that further includes a recoil lug.
Figure 10:
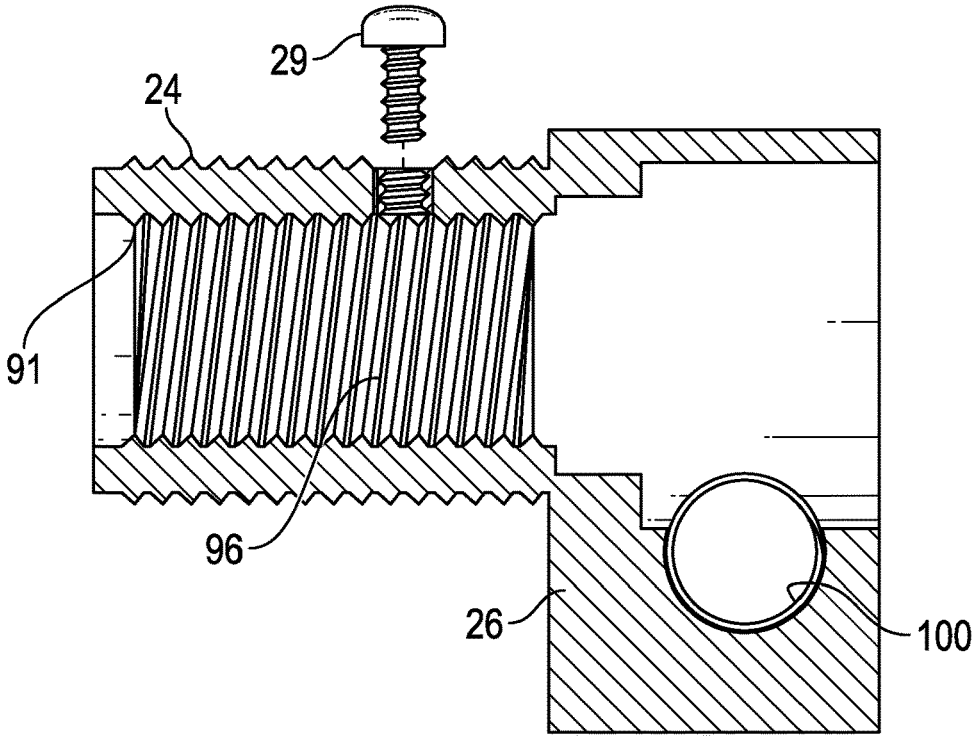
FIG. 10 is a cross-sectional view of a recoil lug embodiment of the invention.

In an alternate embodiment, the firearm 20 is of the type that further includes a recoil lug 26 (FIG. 6) disposed about the barrel 30 and contacting the receiver 80. The recoil lug 26 may be integrally formed with the receiver 90 or included as a separate piece (FIG. 10). Each threaded adjustment bolt aperture 100 may be formed within the recoil lug 26, instead of the receiver 80, and aligned to tangentially intersect the barrel 30, which has the tangential notches 60 formed, in this embodiment, proximate the action end 32 but not within the threaded portion 50.

Figure 11:
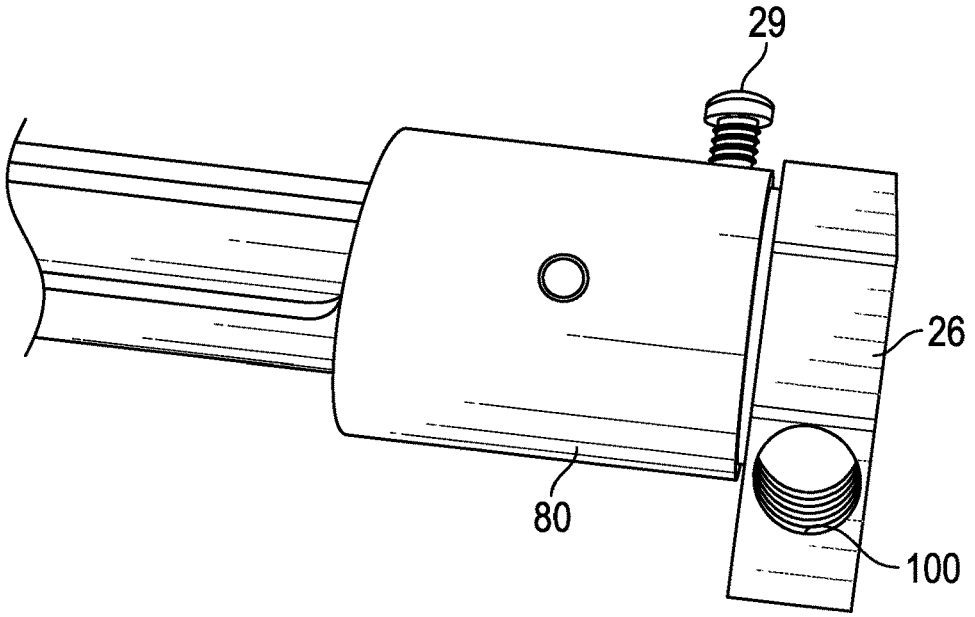
FIG. 11 is a side elevational view of the embodiment of FIG. 10.

In the embodiment shown in FIGS. 10 and 11, the recoil lug 26 includes a second barrel port 91 with the internal threaded surface 96 adapted to receive ethe threaded portion 50 of the action end 32 of any of the barrels 30 therewithin. Additionally the recoil lug 26 includes an outer threaded area 24 adapted for threaded engagement with the internal threaded surface 95 of the barrel port 90 of the receiver 80. A locking screw 29 holds the recoil lug 26 rotationally in place on the receiver 80.

Figure 7:
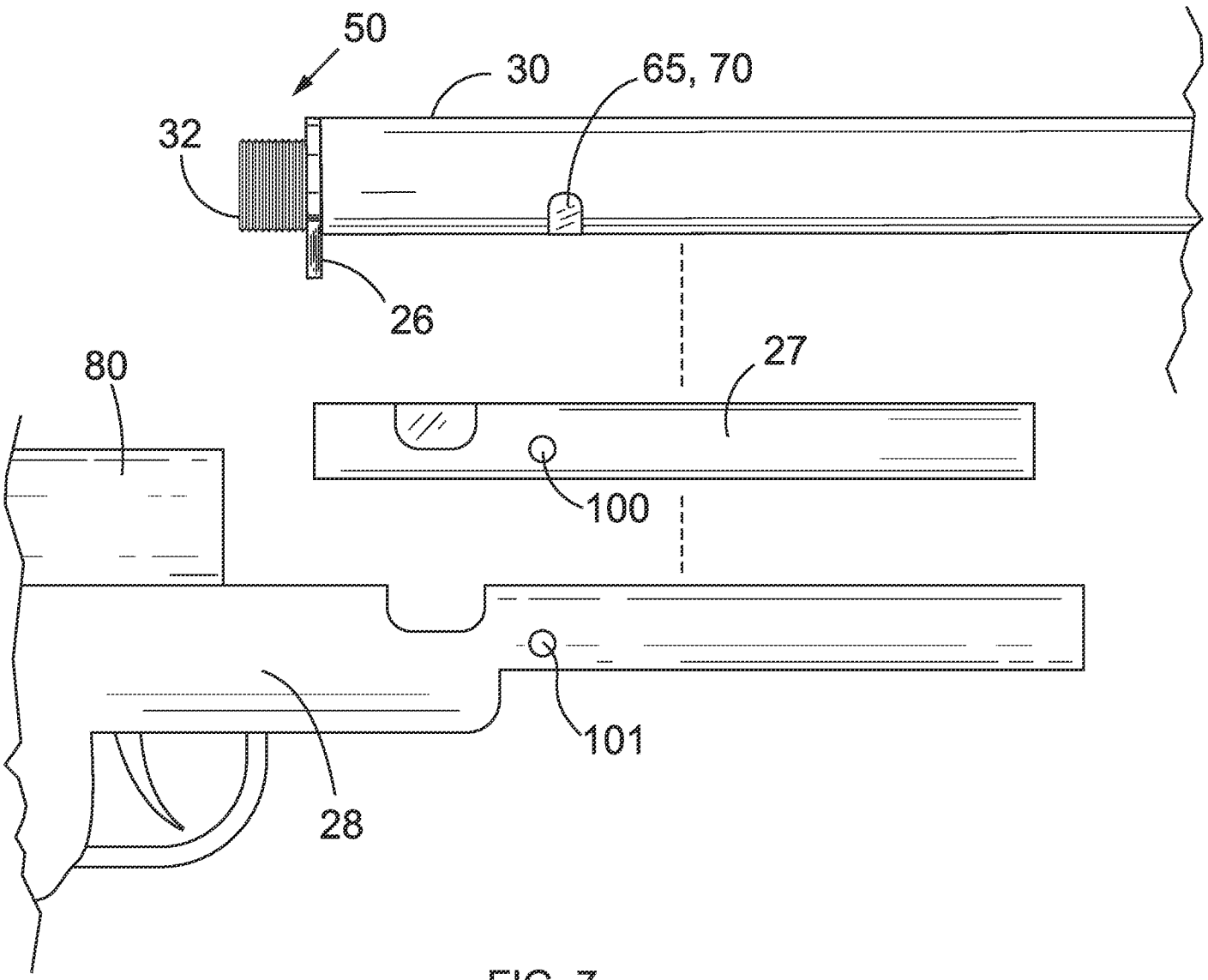
FIG. 7 is an exploded side elevational view of another alternate embodiment of the invention that further includes a bedding support for the barrel.

As another alternate embodiment, the firearm 20 is of the type that further includes a bedding support 27 (FIG. 7) fixed between the barrel 30 and the stock 28. Each threaded adjustment bolt aperture 100 may be formed within the bedding support 28 and aligned to tangentially intersect the barrel 30, which has the tangential notches 60 formed, in this embodiment, proximate the action end 32 but not within the threaded portion 50.

For each of the threaded adjustment bolt apertures 100, the system 10 includes a threaded adjustment bolt 110 that has a distal end 118 adapted for threaded engagement with one of the adjustment bolt apertures 100, and a proximal end 112 that includes a driver receiver 120, such as an Allen socket, a hex bolt, a Phillips screw driver receiver, or the like. The threaded adjustment bolt 110 can be coaligned with the notch 60 until the distal end 118 of the threaded adjustment bolt 110 contacts the end 65 of the notch 60.

In use, with the action end 32 of one of the barrels 30 threadedly engaged with the barrel port 90 and manually tightened to align each threaded adjustment bolt aperture 100 with one of the notches 60, when the adjustment bolt 110 is tightened it contacts the stop 70 to apply a tangential force to the barrel 30 to further tighten the barrel 30 within the receiver 80 and to provide a desired headspace 18 between the action end 32 of the barrel 30 and a bolt 25 of the firearm 20. In this manner the fit of the barrel 30 into the receiver 80 can be adjusted, as well as the headspace 18, as desired. If the barrel 30 becomes damaged, or for any other reason, the barrel 30 can be interchanged with another of the barrels 30 in a similar manner.

In embodiments having two of the threaded adjustment bolts 110 on opposing sides of the stop 70, one of the threaded adjustment bolt 110 is used to tighten the barrel 30 into the barrel port 90, and the other threaded adjustment bolt 110 is used to loosen the barrel 30 from the barrel port 90.

Figure 8:
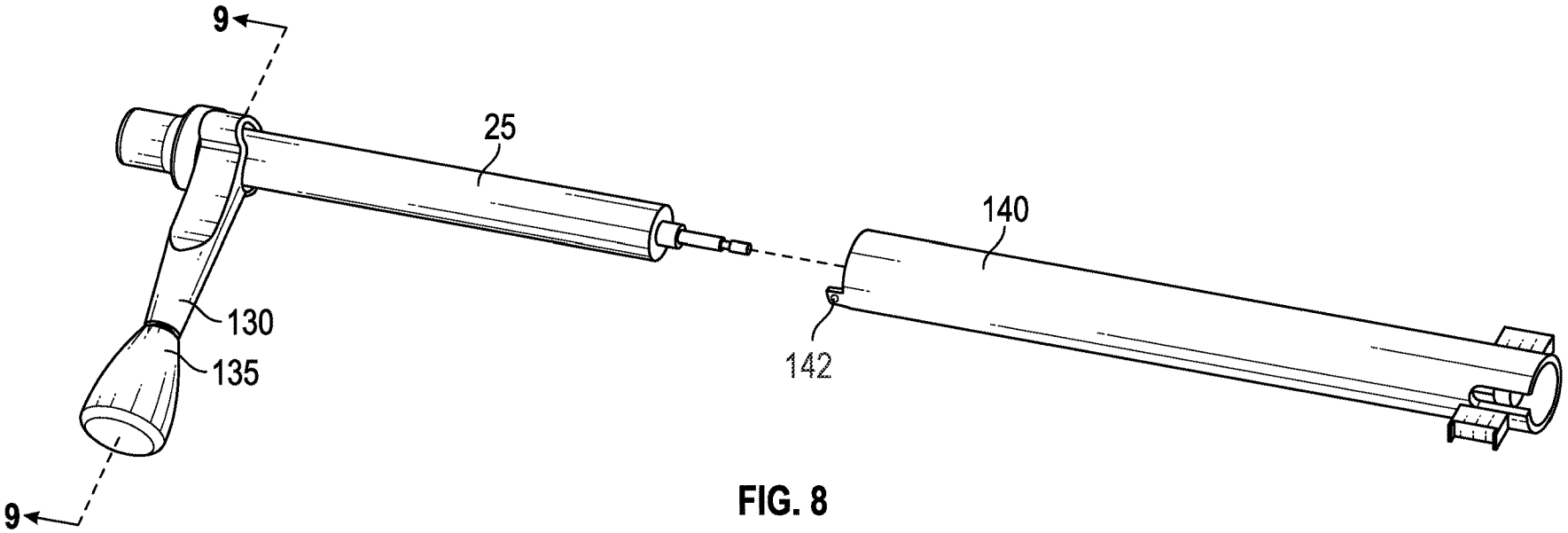
FIG. 8 is an exploded view of an interchangeable bolt and sleeve.
Figure 9:
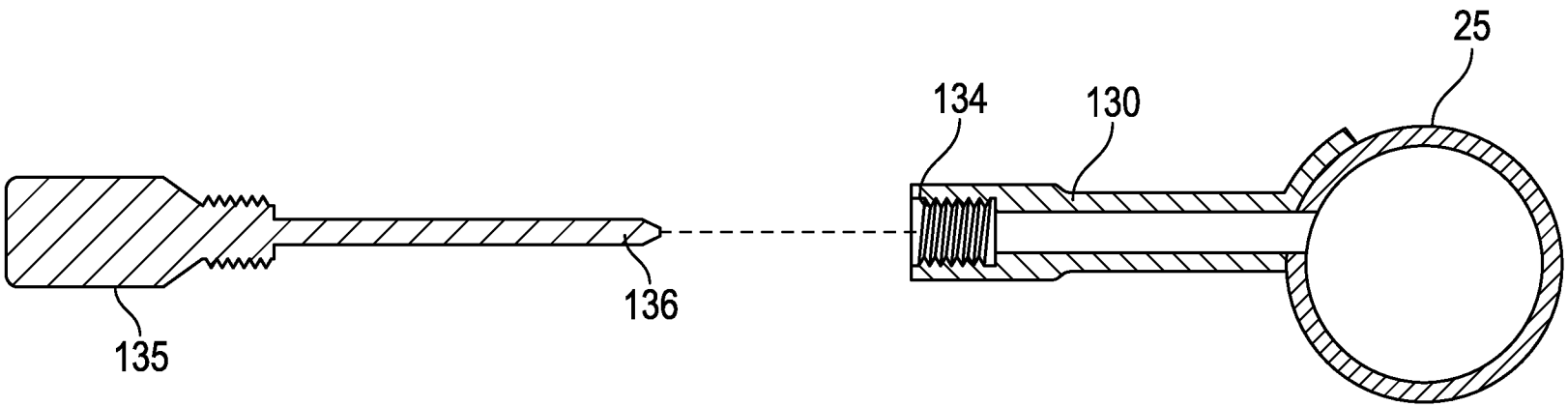
FIG. 9 is an exploded cross-sectional view of the bolt with a bolt handle having a bolt knob with a retaining pin.

In some embodiments, the bolt 25 is interchangeable to correspond with the caliber of any particular barrel 30. In such an embodiment, a bolt handle 130 (FIGS. 8 and 9) fixed with the bolt 25 includes an axial bore 134 through which a handle knob 135 connected to a threaded retaining pin 136 traverses. The treaded retaining pin 136 engages a bolt sleeve 140 (FIG. 8) at a bolt tab and aperture 142. The bolt sleeve 140 is adapted for the particular firearm 20. The retaining pin 136 fixes the bolt sleeve 140 to the bolt 25 and bolt handle 130. In this way, interchangeable bolts 25 with the bolt handle 130 can be utilized so as to match the caliber of any particular barrel 30 that is used with the firearm 20.

While a particular form of the invention has been illustrated and described, it will be apparent that various modifications can be made without departing from the spirit and scope of the invention. For example, more than two of the threaded adjustment bolt apertures 100 may be formed in the receiver 80 at 15-degree to 30-degree angles, so that as the stop 70 passes by one of the threaded adjustment bolt apertures 100, one of the threaded adjustment bolts 110 from an adjacent threaded adjustment bolt aperture 100 may "take over" to further tighten the barrel 30 in the barrel port 90.

Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An interchangeable barrel system for a firearm having at least a stock, a receiver having a threaded barrel port, and a bedding support fixed between a barrel and the stock, comprising:

one or more barrels, each having an outer surface and an inner surface that defines a longitudinal bore open between a muzzle end and an action end, the action end having a threaded portion on the outside surface and including at least one tangential notch formed partially through the barrel proximate the action end, an end of the notch defining a stop, the action end of any of the barrels adapted for engaging the threaded barrel port of the receiver;

the firearm including at least one threaded adjustment bolt aperture that tangentially intersects each barrel at the notch when the barrel is engaged in the barrel port of the receiver; and at least one threaded adjustment bolt having a distal end adapted for threaded engagement with the at least one threaded adjustment bolt aperture of the firearm, and a proximal end having a driver receiver, the threaded adjustment bolt aperture being formed within the bedding support and aligned to tangentially intersect the barrel;

whereby with the action end of one of the barrels threadedly engaged with the barrel port, the stop is aligned within the path of the adjustment bolt that, when tightened, contacts the stop to apply a tangential force to the barrel to further tighten the barrel within the receiver and to provide a desired headspace between the action end of the barrel and a bolt of the firearm.

2. The interchangeable barrel system of claim 1 wherein the threaded adjustment bolt aperture is formed within the receiver and aligned to tangentially intersect the barrel port.

3. The interchangeable barrel system of claim 1 wherein the firearm further includes a recoil lug disposed about the barrel and contacting the receiver, and wherein the threaded adjustment bolt aperture is formed within the recoil lug and aligned to tangentially intersect the barrel.

4. The interchangeable barrel system of claim 1 wherein the bolt of the firearm includes a bolt sleeve fixed thereto at a bolt handle that includes an axial bore through which a handle knob connected with a threaded retaining pin traverses to fix the bolt sleeve to the bolt of the firearm, wherein the bolt of the firearm and bolt handle are interchangeable to correspond with the barrel.

5. An interchangeable barrel system for a firearm having at least a stock and a receiver having a threaded barrel port, comprising:

one or more barrels, each having an outer surface and an inner surface that defines a longitudinal bore open between a muzzle end and an action end, the action end having a threaded portion on the outside surface and including two tangential notches formed partially through the barrel proximate the action end, an end of each notch defining a stop, the action end of any of the barrels adapted for engaging the threaded barrel port of the receiver;

the firearm including two threaded adjustment bolt apertures that tangentially intersect each barrel at one of the notches when the barrel is engaged in the barrel port of the receiver; and two threaded adjustment bolts each having a distal end adapted for threaded engagement with one of the threaded adjustment bolt apertures of the firearm, and a proximal end having a driver receiver;

whereby with the action end of one of the barrels threadedly engaged with the barrel port, the stop is aligned within the path of the adjustment bolts that, when tightened, contacts the stop to apply a tangential force to the barrel to further tighten or loosen the barrel within the receiver and to provide a desired headspace between the action end of the barrel and a bolt of the firearm.

6. The interchangeable barrel system of claim 5 wherein the threaded adjustment bolt apertures are formed within the receiver and aligned to tangentially intersect the barrel port.

7. The interchangeable barrel system of claim 5 wherein the firearm further includes a recoil lug disposed about the barrel and contacting the receiver, and wherein the threaded adjustment bolt apertures are formed within the recoil lug and aligned to tangentially intersect the barrel.

8. The interchangeable barrel system of claim 5 wherein the firearm further includes a bedding support fixed between the barrel and the stock, and wherein the threaded adjustment bolt apertures are formed within the bedding support and aligned to tangentially intersect the barrel.

9. The interchangeable barrel system of claim 5 wherein the bolt of the firearm includes a bolt sleeve fixed thereto at a bolt handle that includes an axial bore through which a handle knob connected with a threaded retaining pin traverses to fix the bolt sleeve to the bolt of the firearm, wherein the bolt of the firearm and bolt handle are interchangeable to correspond with the barrel.

10. An interchangeable barrel system for a firearm having at least a stock and a receiver having a threaded barrel port, comprising:

one or more barrels, each having an outer surface and an inner surface that defines a longitudinal bore open between a muzzle end and an action end, the action end having a threaded portion on the outside surface and including two tangential notches formed partially through the barrel proximate the action end, an end of each notch defining a stop, the action end of any of the barrels adapted for engaging the threaded barrel port of the receiver;

a recoil lug having a second barrel port with an internal threaded surface adapted to receive the threaded portion of the action end of any of the barrels therewithin, the recoil lug further including an outer threaded area adapted for threaded engagement with the internal threaded surface of the barrel port of the receiver, at least one threaded adjustment bolt aperture being formed within the recoil lug and aligned to tangentially intersect the barrel when the barrel is engaged with the second barrel port of the recoil lug, the recoil lug further including a threaded locking screw aperture and wherein a threaded locking screw holds the recoil lug rotationally in place on the receiver; and at least one threaded adjustment bolt having a distal end adapted for threaded engagement with one of the threaded adjustment bolt apertures of the recoil lug, and a proximal end having a driver receiver;

whereby with the recoil lug threadedly engaged with the barrel port of the receiver, and with the action end of one of the barrels threadedly engaged with the second barrel port of the recoil lug, the stop of the barrel is aligned within the path of the at least one adjustment belts bolt that, when tightened, contacts the stop to apply a tangential force to the barrel to further tighten or loosen the barrel within the recoil lug and to provide a desired headspace between the action end of the barrel and a bolt of the firearm.

* * * * *